US007707901B2

(12) United States Patent
Lancaster, III et al.

(10) Patent No.: US 7,707,901 B2
(45) Date of Patent: May 4, 2010

(54) APPARATUS AND METHOD FOR MEASURING CONTAINMENT FORCE IN A WRAPPED LOAD AND A CONTROL PROCESS FOR ESTABLISHING AND MAINTAINING A PREDETERMINED CONTAINMENT FORCE PROFILE

(75) Inventors: Patrick R. Lancaster, III, Louisville, KY (US); David E. Eldridge, Fern Creek, KY (US); Curtis W. Martin, Georgetown, KY (US)

(73) Assignee: Lantech.com LLC, Louisville, KY (US)

( * ) Notice: Subject to any disclaimer, the term of this patent is extended or adjusted under 35 U.S.C. 154(b) by 130 days.

(21) Appl. No.: 12/106,950

(22) Filed: Apr. 21, 2008

(65) Prior Publication Data

US 2008/0295614 A1 Dec. 4, 2008

Related U.S. Application Data

(60) Provisional application No. 60/907,838, filed on Apr. 19, 2007.

(51) Int. Cl.
*G01L 1/26* (2006.01)

(52) U.S. Cl. ..... 73/862.391; 73/862.451; 73/862.471; 73/862.393

(58) Field of Classification Search ..... 73/862.391–862.451
See application file for complete search history.

(56) References Cited

U.S. PATENT DOCUMENTS

| | | | | |
|---|---|---|---|---|
| 4,497,159 | A * | 2/1985 | Lancaster, III | 53/556 |
| 4,866,909 | A * | 9/1989 | Lancaster et al. | 53/399 |
| 5,054,263 | A * | 10/1991 | Maki-Rahkola et al. | 53/399 |
| 5,836,140 | A * | 11/1998 | Lancaster, III | 53/399 |
| 6,848,240 | B2 * | 2/2005 | Frey | 53/556 |
| 2007/0204564 | A1 * | 9/2007 | Lancaster et al. | 53/399 |

* cited by examiner

*Primary Examiner*—Max Noori
(74) *Attorney, Agent, or Firm*—Finnegan, Henderson, Farabow, Garrett & Dunner, LLP

(57) ABSTRACT

An apparatus and method for measuring containment force on a load is provided. The apparatus may include a first longitudinally extending arm configured to engage a first side of packaging material wrapped around the load. The apparatus may also include a second longitudinally extending arm configured to engage a second side of the packaging material, the second side being opposite the first side. The apparatus may further include an indicator positioned substantially perpendicularly to the first and second arms, a third longitudinally extending arm, and a force gauge configured to measure a force exerted on the third longitudinally extending arm.

25 Claims, 14 Drawing Sheets

APPARATUS AND METHOD FOR MEASURING CONTAINMENT FORCE IN A WRAPPED LOAD AND A CONTROL PROCESS FOR ESTABLISHING AND MAINTAINING A PREDETERMINED CONTAINMENT FORCE PROFILE

This application claims priority under 35 U.S.C. § 119 based on U.S. Provisional Application No. 60/907,838, filed Apr. 19, 2007, the complete disclosure of which is incorporated herein by reference.

TECHNICAL FIELD

The present disclosure relates to process control techniques for establishing and maintaining a containment force profile for businesses that utilize load wrapping systems. The present invention also relates to a device for measuring containment forces exerted on a load by packaging material wrapped around the load. The present disclosure further relates to determining a containment force profile of a wrapped load to help improve the efficiency of the wrapping process.

BACKGROUND

Various packaging techniques have been used to build a load of unit products and subsequently wrap them for transportation, storage, containment and stabilization, protection and waterproofing. Products are often stacked as a load on a pallet to simplify handling of the products. The load is commonly wrapped with packaging material. One system uses wrapping machines to dispense and wrap packaging material around a load. Wrapping can be performed as an inline, automated packaging technique that dispenses and wraps packaging material around a load to cover and contain the load. Wrapping, whether accomplished by a turntable, rotating arm, vertical rotating ring, or horizontal rotating ring, typically covers the four vertical sides of the load with a film such as polyethylene film. In each of these arrangements, relative rotation is provided between the load and the packaging material dispenser to wrap packaging material about the sides of the load.

Wrapping machines provide relative rotation between a packaging material dispenser and a load either by driving the packaging material dispenser around a stationary load, or by rotating the load on a turntable. Upon relative rotation, packaging material is wrapped on the load. Ring style stretch wrappers generally include a roll of packaging material mounted in a dispenser that rotates about the load on a ring. Vertical rings move substantially vertically between an upper and lower position to wrap film around a load. In a vertical ring, as in turntable and rotating wrap arm apparatuses, the four vertical sides of the load are wrapped, along the height of the load.

When loads are wrapped, it is beneficial to wrap the film around the base of the load. If the load is on a pallet, it is beneficial to wrap the film around at least a top portion of the pallet supporting the load in order to secure the load to the pallet. The film exerts a containment force on the load, which may help to maintain the integrity of the load during transport. In other words, the film helps to keep the articles composing the wrapped load in the arrangement they are in immediately after being wrapped. If the containment force is insufficient, shifting of the load may occur during shipping. Shifting may lead to instability and/or damage to the load.

Containment force is the force exerted on the load by the packaging material wrapped around the load. Various devices and techniques have been used to measure the containment force exerted on a load by packaging material wrapped around the load. One such device that is Applicant's own work is illustrated in FIG. 10. The device includes a gauge that is coupled to a plate or disc. In order to use the device, a user makes a slit in the packaging material, and inserts the plate or disc through the slit so that the plate or disc is located between the packaging material and a surface of the load. The user holds a first end of a measuring device, such as a measuring tape, against the load surface, and then positions it so that it extends in a direction normal to the load surface. With the plate or disc and the measuring device in place, the user pulls the gauge outwardly in a direction normal to the surface of the load to a predetermined point along the measuring device. The reading on the gauge is indicative of the containment force. This device and technique had marginal success only, due to inaccuracy and difficulty of use. For example, the device could catch a gap between layers of packaging material, leading to inaccurate and unpredictable measurements. Furthermore, simultaneously pulling and holding the gauge, measuring the distance pulled, and reading the gauge, proved to be physically difficult for some users. Finally, it was not possible to obtain consistent results from one user to another.

Another device, also Applicant's own work, incorporates the use of a swiveling arm member that forms a "T" for engaging the packaging material. However, this device also has various drawbacks. For example, use of the device requires weakening the packaging material by cutting a relatively large horizontal slit in the packaging material to receive the swiveling arm, which is then rotated 90° into the position shown in FIG. 11. Furthermore, measurements obtained using this device proved to be inconsistent, and results were highly dependent upon operator technique. Additionally, the technique for using this device was slow and inefficient.

A subsequent device, also Applicant's own work, is illustrated in FIG. 12. The device includes two arms. A first arm engages a first side of the packaging material, and a second arm engages a second, opposite side of the packaging material. A base extends from the tops of the first and second arms, to which a gauge is attached. With the first and second arms in place and engaging the packaging material, a user pulls the gauge along a plane defined by the base. This device also suffers from drawbacks. For example, the device is limited to testing the packaging material at only the top or bottom of the load. Also, the exertion of a pulling force by the user at the top of the first and second arms causes distortion in the packaging material being tested. Furthermore, the device is only capable of taking relatively small vertical samples of the packaging material, and results tend to be inconsistent due to overlapped film variations.

The above-described devices for measuring containment force on wrapped loads suffer from flawed design, are difficult to use, cause substantial damage to the packaging material, and often times produce unreliable and inconsistent results. For these reasons, there is a need for containment force measuring device that can consistently produce fast, accurate, precise, and reliable results, while also being easy to use.

It is accordingly a primary object of the disclosure to provide a method and apparatus for measuring containment force on a wrapped load that can be used quickly and easily.

It is an additional object of the present disclosure to provide a method and apparatus for measuring containment force on a wrapped load with accuracy and precision.

It is an additional object of the present disclosure to provide a method and apparatus for measuring containment force on a wrapped load that is robust, and is capable of being used in any environment.

It is an additional object of the present disclosure to provide a method and apparatus for measuring containment force on a wrapped load that will cause minimal damage to the packaging material wrapped around the load.

SUMMARY

In accordance with the disclosure, an apparatus for measuring containment force on a load is provided. The apparatus may include a first longitudinally extending arm configured to engage a first side of packaging material wrapped around the load. The apparatus may also include a second longitudinally extending arm configured to engage a second side of the packaging material, the second side being opposite the first side. The apparatus may further include an indicator positioned substantially perpendicularly to the first and second arms. The apparatus may further include a third longitudinally extending arm, and a force gauge configured to measure a force exerted on the third longitudinally extending arm.

According to another aspect of the present disclosure, a method for determining containment force on a wrapped load is provided. The method may include positioning a portion of packaging material wrapped on the load between first and second arms of a force measuring device, rotating the first and second arms from an initial position to an end position, and measuring a force required to rotate the first and second arms to the end position.

According to another aspect of the present disclosure, a process for optimizing a wrapping process is provided. The process may include identifying a wrapped load in a substantially "as made" condition after shipping. The process may also include measuring a containment force profile of the identified load to obtain a desired containment force profile. The process may further include varying settings on a wrapping apparatus to obtain the desired containment profile at a desired cost, thus creating a desired wrapping profile. The process may further include wrapping loads at the desired wrapping profile, and measuring a containment force profile of at least one load wrapped at the desired wrapping profile subsequent to shipping.

According to another aspect of the present disclosure, a wrapping process control method is provided. The method may include wrapping loads at a first setting, and identifying a baseline containment force profile of a selected wrapped load. The method may also include selectively adjusting the setting to identify an adjusted setting that is capable of producing the baseline containment force profile, and using the adjusted setting to wrap a subsequent load.

According to another aspect of the present disclosure, a wrapping process control method is provided. The method may include measuring a containment force profile of a wrapped load that has been transported from an origin to a destination, and has arrived at the destination in a satisfactory condition, and measuring a containment force profile of a subsequently wrapped load at the origin, and qualifying the subsequently wrapped load by determining whether the containment force profile of the subsequently wrapped load meets the containment force profile of the wrapped load.

Additional objects and advantages of the disclosed embodiments will be set forth in part in the description which follows, and in part will be obvious from the description, or may be learned by practice of the disclosed embodiments. The objects and advantages of the disclosed embodiments will be realized and attained by means of the elements and combinations particularly pointed out in the appended claims.

It is to be understood that both the foregoing general description and the following detailed description are exemplary and explanatory only and are not restrictive of the claimed features.

The accompanying drawings, which are incorporated in and constitute a part of this specification, illustrate aspects of the disclosure, and together with the description, serve to explain the principles of the embodiments.

BRIEF DESCRIPTION

DETAILED DESCRIPTION

Figure 1:
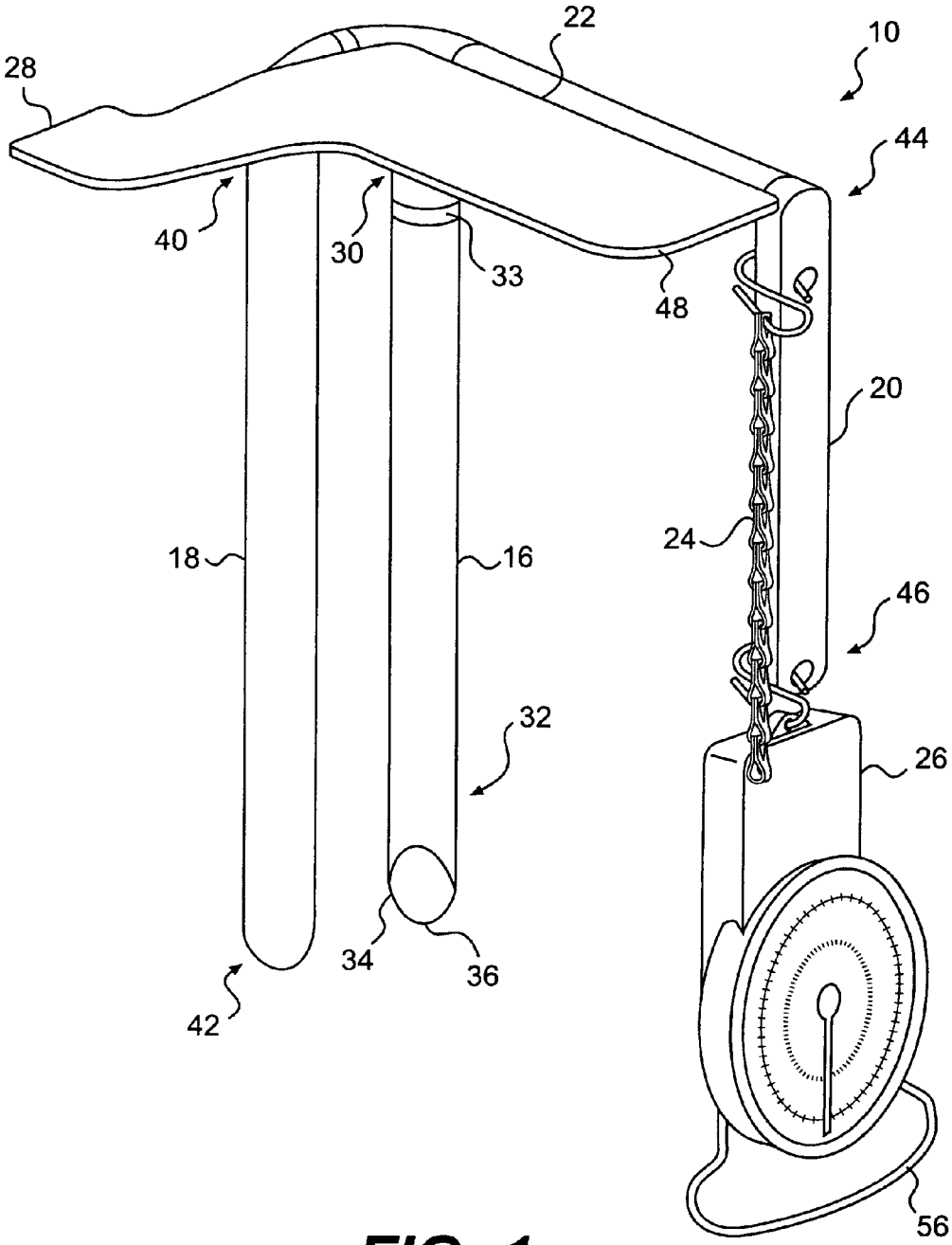
FIG. 1 is a perspective view of an apparatus for measuring containment force, according to one aspect of the disclosure.
Figure 2:
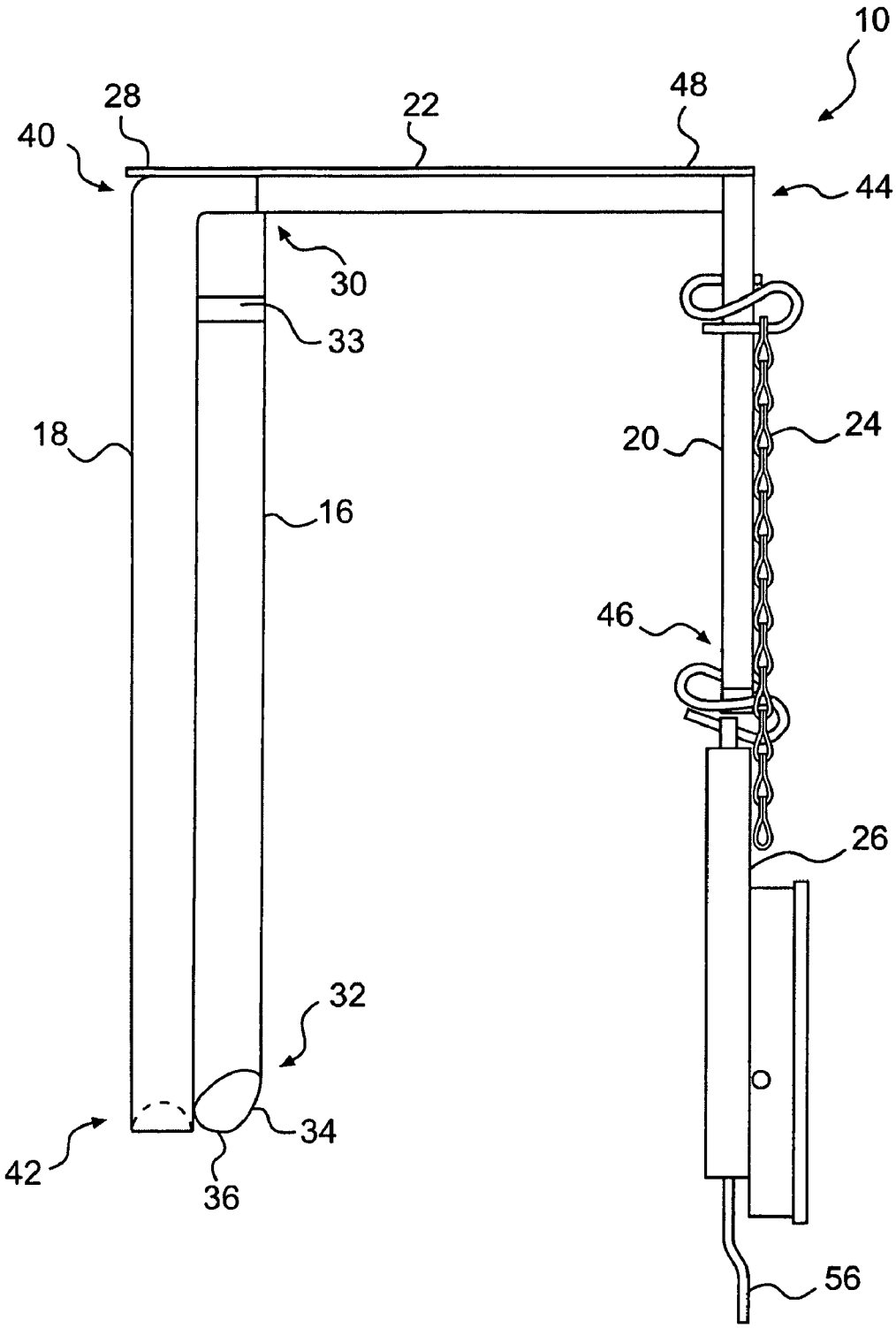
FIG. 2 is a front view of the apparatus of FIG. 1, according to one aspect of the disclosure.
Figure 3:
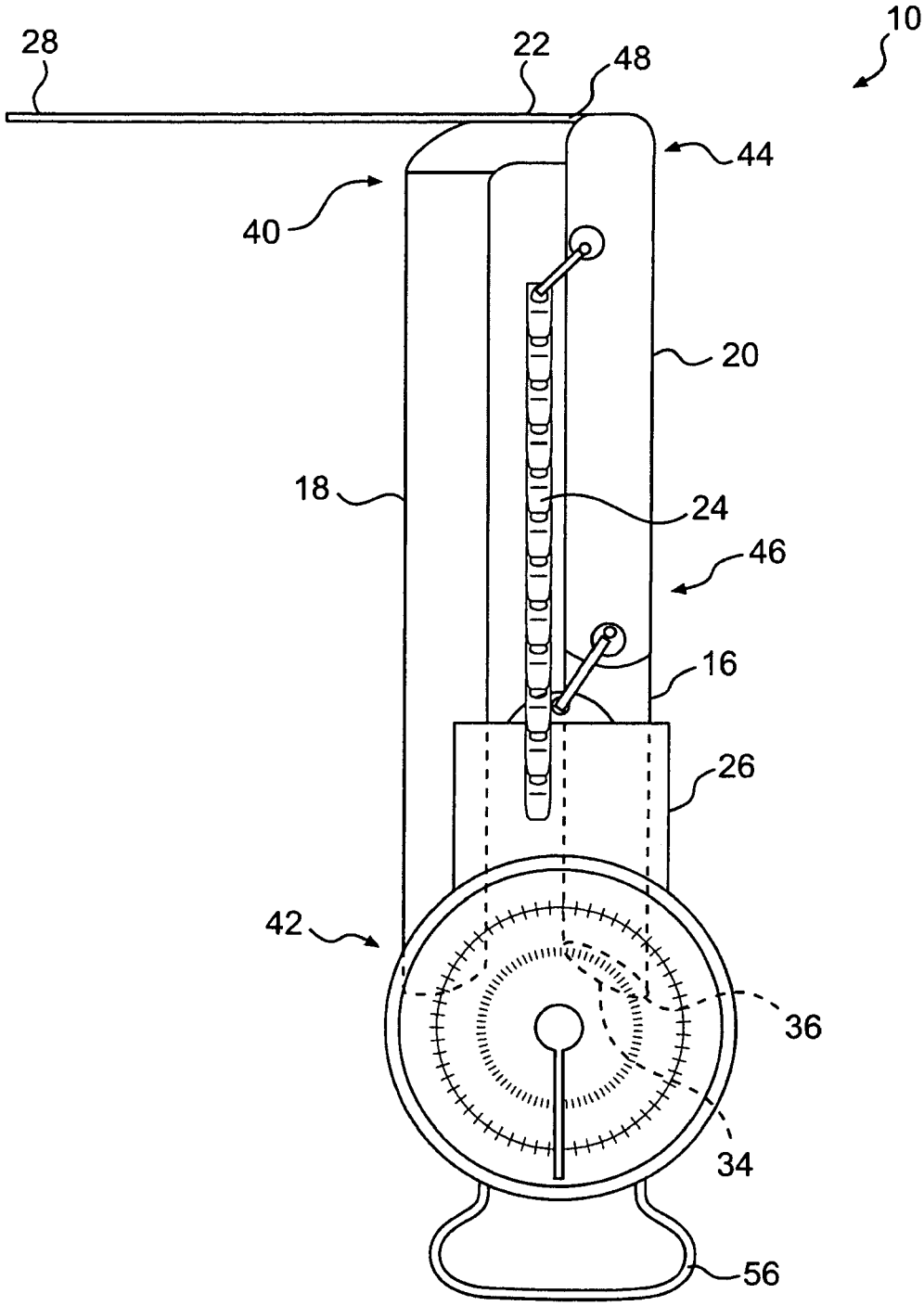
FIG. 3 is a side view of the apparatus of FIG. 1, according to one aspect of the disclosure.
Figure 4:
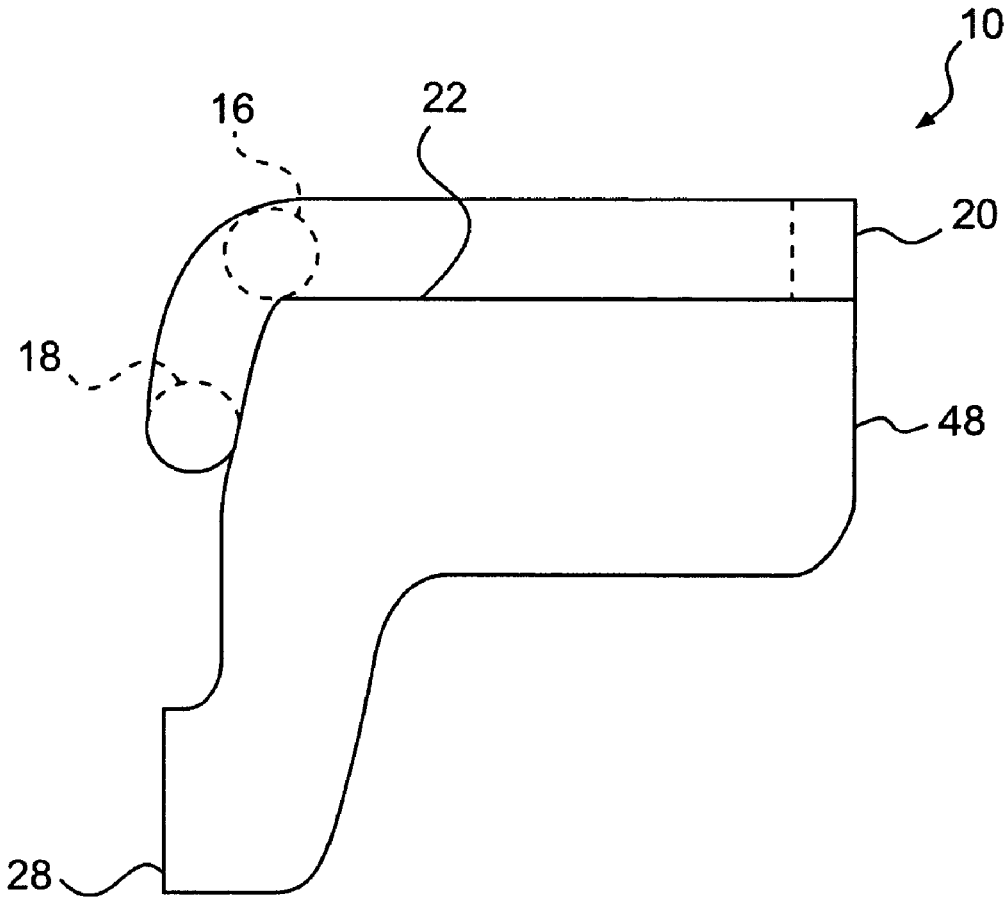
FIG. 4 is a top view of the apparatus of FIG. 1, according to one aspect of the disclosure.

Reference will now be made in detail to aspects of the disclosed embodiments, examples of which are illustrated in the accompanying drawings. Wherever possible, the same reference numbers will be used throughout the drawings to refer to the same or like parts.

A packaging material dispenser may dispense a sheet of film in a web form. In an exemplary embodiment, the film web may be stretch wrap packaging material. However, it should be understood that various other packaging materials such as netting, strapping, banding, or tape may be used as well. As used herein, the terms "packaging material," "web," "film," "film web," and "packaging material web" may be used interchangeably. The packaging material dispenser may include a pre-stretch assembly including pre-stretch rollers configured to rotate at different speeds to stretch the film web. For example, the surface movement of one pre-stretch roller may differ in speed from another by about 40%, 75%, 200% or 300%, to obtain pre-stretching of 40%, 75%, 200% or 300%. Rapid elongation of the film web by the pre-stretch assembly, followed by rapid strain relief of the film web, may cause a "memorization" effect. Due to this "memorization" effect, the film web may actually continue to shrink for some time after being wrapped onto a load. Over time, the film web may significantly increase holding force and conformation to the load. This characteristic of the film web may allow it to be used for wrapping loads, using the memory to build containment force and load conformity.

Containment force is the relative containment force exerted on all areas of the load by the layers of packaging material wrapped around the load. Containment force varies based on the type of film used (brand), the film gauge (thickness of film), the prestretch level, and the wrap force. Variation of any one of these factors may result in a change in the containment force on the wrapped load. Containment force is a primary determinant of whether the load will be maintained in the "as made" or "as wrapped" condition during and after shipment. Loads wrapped with higher containment forces often survive the shipping process in better condition. A load may be described as having survived the shipping process if the load arrives at its destination in a satisfactory condition (e.g., the load has not shifted during shipping, the items forming the load have not been crushed or torn during shipping, and/or the packaging material surrounding the load has not torn or unraveled during shipping). However, above a certain containment force, gains made in the condition of the load during and after shipping decrease while costs for achieving the containment force increase. For this reason, it is desirable to determine an "optimum" containment force that is sufficiently high to permit the load to survive shipping in an acceptable condition, while simultaneously identifying a containment force that also will minimize the costs associated with wrapping the load.

The containment force on the load is not consistent throughout the load. That is, a wrapped load may have a first containment force on a top portion of the load, a second containment force on the middle portion of the load, and a third containment force on a bottom of the load. The different containment forces at different portions of the load define a containment force profile of the load. Often, the top and middle containment forces will be the same and the bottom containment force will be higher. This may be due to the use of roping or gathering of film to wrap the base of the load and the pallet. It may also be due to the wrapping of additional layers of film on a lower portion of the load. Alternatively, the containment forces may be substantially the same throughout the load, or higher at the top or middle of the load. The containment force measuring tool of the present disclosure may be used to measure a containment force profile of the load without measuring the force of a rope of film around a bottom of the load. Alternatively, the measuring device may be used to separately determine the containment force provided by a rope around a base of the load. A containment force profile for a given wrapped load may be determined by measuring the containment force of the wrapped load at the top, middle, and bottom of the wrapped load. For example, inspection of loads after shipping may allow the selection of loads that are in a "satisfactory" condition after shipping. A load is in a satisfactory condition if the load has not shifted during shipping, the items forming the load have not been crushed or torn during shipping, and/or the packaging material surrounding the load has not torn or unraveled during shipping.

After identifying a containment force profile that yields loads that arrive at an end destination in a satisfactory condition, it is possible to vary the film selection, film gauge, prestretch level (if any), and wrap force used during the wrapping process to determine a combination of those factors that will provide the most cost effective way to achieve the identified containment force profile. The same containment force may be obtained in a variety of ways. For example, by applying many layers of film at a low wrap force or by applying fewer layers of film at a higher wrap force. The resulting containment force yields the same result during shipping regardless of how the containment force is achieved. Once such wrapping process parameters have been established, all loads can be wrapped at the same containment force profile.

According to one aspect of the present disclosure, an apparatus for measuring containment force on a wrapped load is provided. An apparatus 10 for measuring the containment force is shown in FIGS. 1-8. The apparatus 10 may be used on a load 12 that is wrapped with packaging material 14. The load 12 may be on a pallet. The packaging material 14 may include one or more layers of a web of film, wrapped spirally around the load 12. The apparatus 10 may include a piercing arm 16, a rolling arm 18, a centering arm 20, a transverse support 22, a measuring device 24, a gauge 26, and an indicator abutment 28. These elements are described in greater detail below.

The piercing arm 16 includes a fixed end 30 and a free end 32. The distance between the fixed and 30 and the free end 32 may be at least as long as half of the width of the film web. For example, if the width of the film web is 20 inches, then the piercing arm may be ten inches in length or longer. It should be noted that the larger the sample of packaging material measured for containment force is, the greater the containment force reading will be. For example, a sample of ten inches will give a first reading and a sample of thirteen inches will give a second reading approximately 30% greater than the first reading. The length of the sample is equal to the span of film engaged by piercing arm 16.

Figure 6:
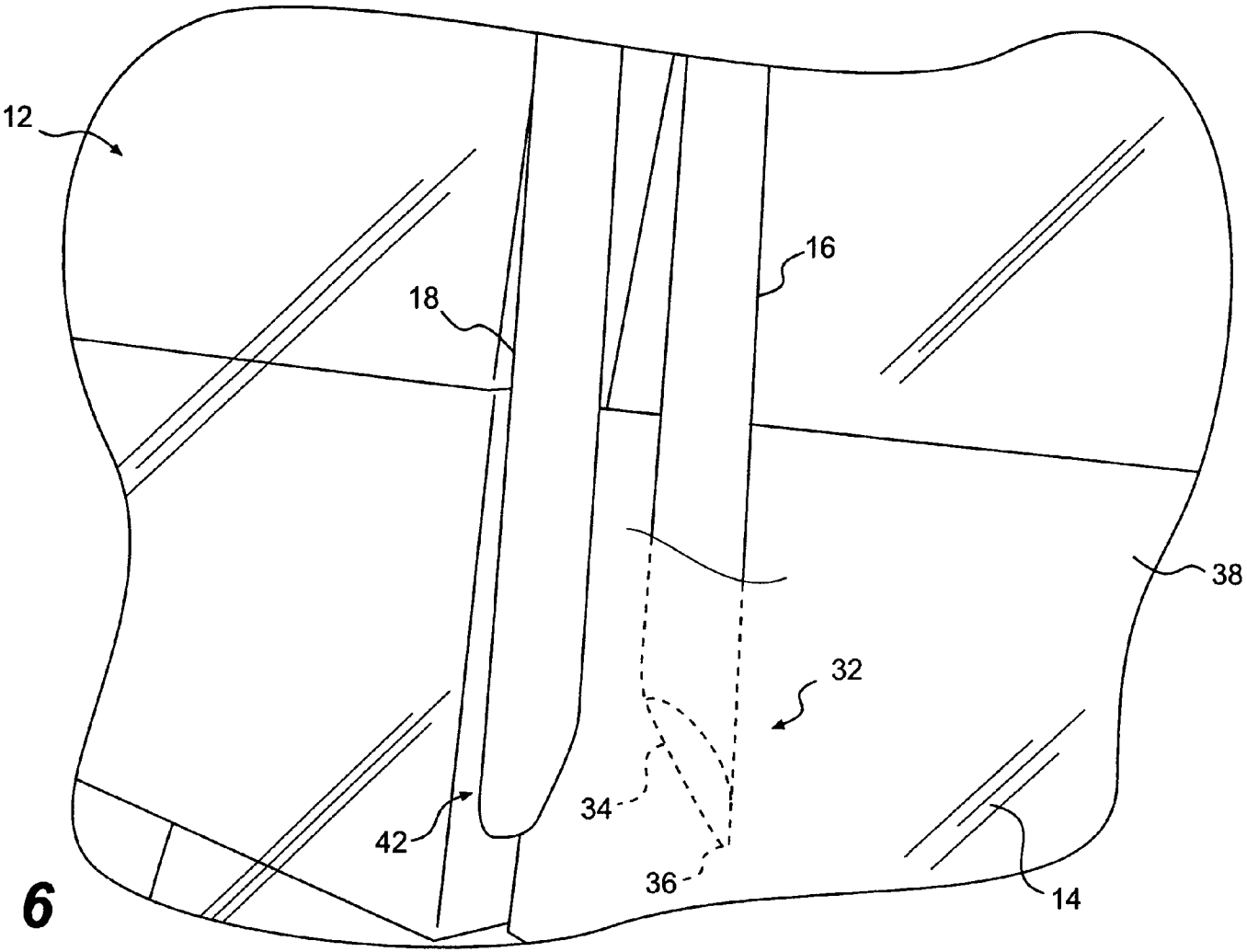
FIG. 6 is a perspective view of the apparatus of FIG. 1 in use, according to another aspect of the disclosure.

The free end 32 of the piercing arm 16 may include a sharp edge 34 and a point 36. As shown in FIG. 6, a user may use the free end 32 to pierce the packaging material 14 wrapped on the load to create an aperture in the packaging material, allowing the user to insert the length of the piercing arm 16 behind the layers of packaging material 14. Once inserted, the piercing arm 16 occupies a position between the packaging material 14 and a surface 38 of the load. It is contemplated that the piercing arm 16 may engage an inner surface of the packaging material 14 that faces the load surface 38. It is also contemplated that the surface of the piercing arm 16 may be treated or coated to reduce the friction between the surface of the piercing arm 16 and the packaging material 14. This may allow the piercing arm 16 to slide through and behind the packaging material more easily. The piercing arm 16 may also include a locator mark 33 proximate its fixed end 30. The user may stop inserting the piercing arm 16 when the aperture reaches the locator mark 33. The locator mark 33 helps to ensure that piercing arm 16 will engage substantially the same length of packaging material 14 each time the piercing arm 16 is inserted. Also, stopping the insertion movement of the piercing arm 16 once the aperture reaches the locator mark 33 prevents bunching up or sagging of the packaging material 14 that may occur if the insertion movement of the piercing arm 16 is allowed to continue past the locator mark 33. Further, the locator mark 33 sets a standard length for the length of the packaging material 14 being tested, which helps with the accuracy, precision, and repeatability of the containment force measurements taken with the apparatus 10. In a preferred embodiment, the locator mark 33 may be set ten inches from the point 36 of the piercing arm 16. Accordingly, the piercing arm 16 engages a ten inch length of the packaging material 14 during testing. While the length may be set to more or less than ten inches, ten inches has been found to be desirable because it is long enough to provide an accurate containment force measurement, but not so long that the piercing arm 16 will be difficult for users to wield. Once the piercing arm 16 has been fully inserted into the aperture so the locator mark 33 is level with the aperture, the packaging material 14 may exert a compressive force on the piercing arm 16 in the direction of the load surface 38, which holds the piercing arm 16 in place, thus preventing piercing arm 16 from sliding down any further into the aperture.

Figure 7:
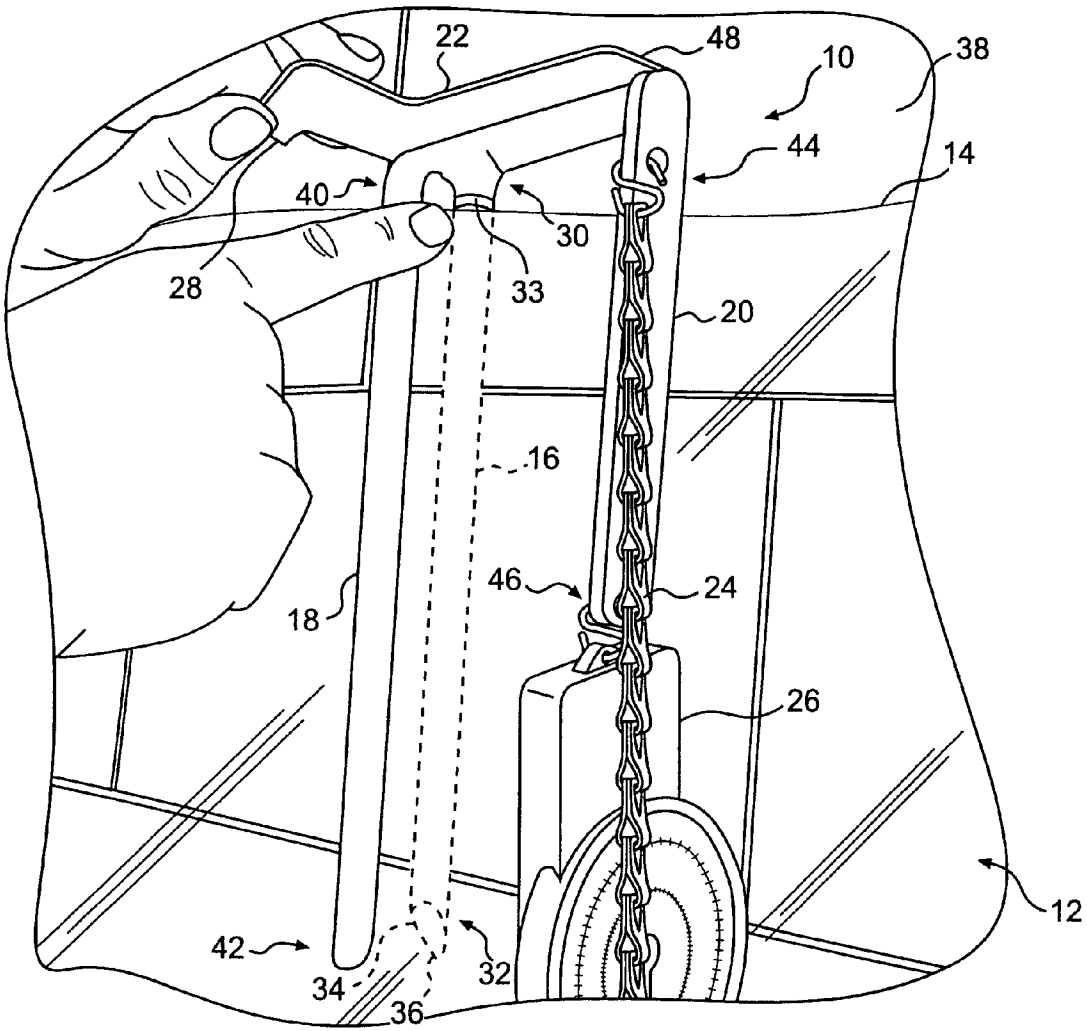
FIG. 7 is a perspective view of the apparatus of FIG. 1 in use, according to yet another aspect of the disclosure.

The rolling arm 18 includes a fixed end 40 and a free end 42. The fixed end 40 of the rolling arm 18 may be coupled to the fixed end 30 of the piercing arm 16. The longitudinal axis of the rolling arm 18 may be substantially parallel to the longitudinal axis of the piercing arm 16. The rolling arm 18 is configured to engage an outer surface of the packaging material 14 after the piercing arm 16 has been inserted into the packaging material 14, as shown in FIGS. 6 and 7. Like the piercing arm 16, the distance between the fixed end 40 and the free end 42 of the rolling arm 18 may be at least as long as half of the width of the film web. It is also contemplated that the surface of the rolling arm 18 may be treated or coated to reduce the friction between the surface of the rolling arm 18 and the packaging material 14. This may allow the rolling arm 18 to slide into position more easily.

The centering arm 20 includes a fixed end 44 and a free end 46. The fixed end 44 of the centering arm 20 cantilevers from a distal end 48 of the transverse support 22, which is coupled to the fixed ends 30 and 40 of the piercing and rolling arms 16 and 18. The length of the centering arm 20 may be approximately half as long as the distance between the fixed and free ends 30 and 32 of the piercing arm 16, or half as long as the distance between the fixed and free ends 40 and 42 of the rolling arm 18.

On its fixed end 44, the centering arm 20 is coupled to the measuring device 24. The measuring device 24 may include, for example, a predetermined length of rope or chain. The fixed length of the rope or chain is such that it permits a user to locate a consistent point on the side surface of the load from a corner of the load, each time testing is being performed. For example, if the load is a square load, the fixed length will be approximately half of the width of the side of the load. If the load is a rectangular load, the fixed length may be selected so that the measuring device 24 can be used on both the long and short sides of the load. The fixed length may be more or less than half of the width of a side of a load, just as long as the fixed length allows a user to consistently locate a point that is a predetermined distance away from a corner of the load when testing for each load is performed. It is contemplated that several different measuring devices may be provided with the apparatus 10 in order to allow the user to accommodate loads of different sizes. Additionally or alternatively, measuring device 24 may be adjustable in length. It is also contemplated that the measuring device 24 may be connected to the centering arm 20 at any point along the length of the centering arm 20.

Figure 5:
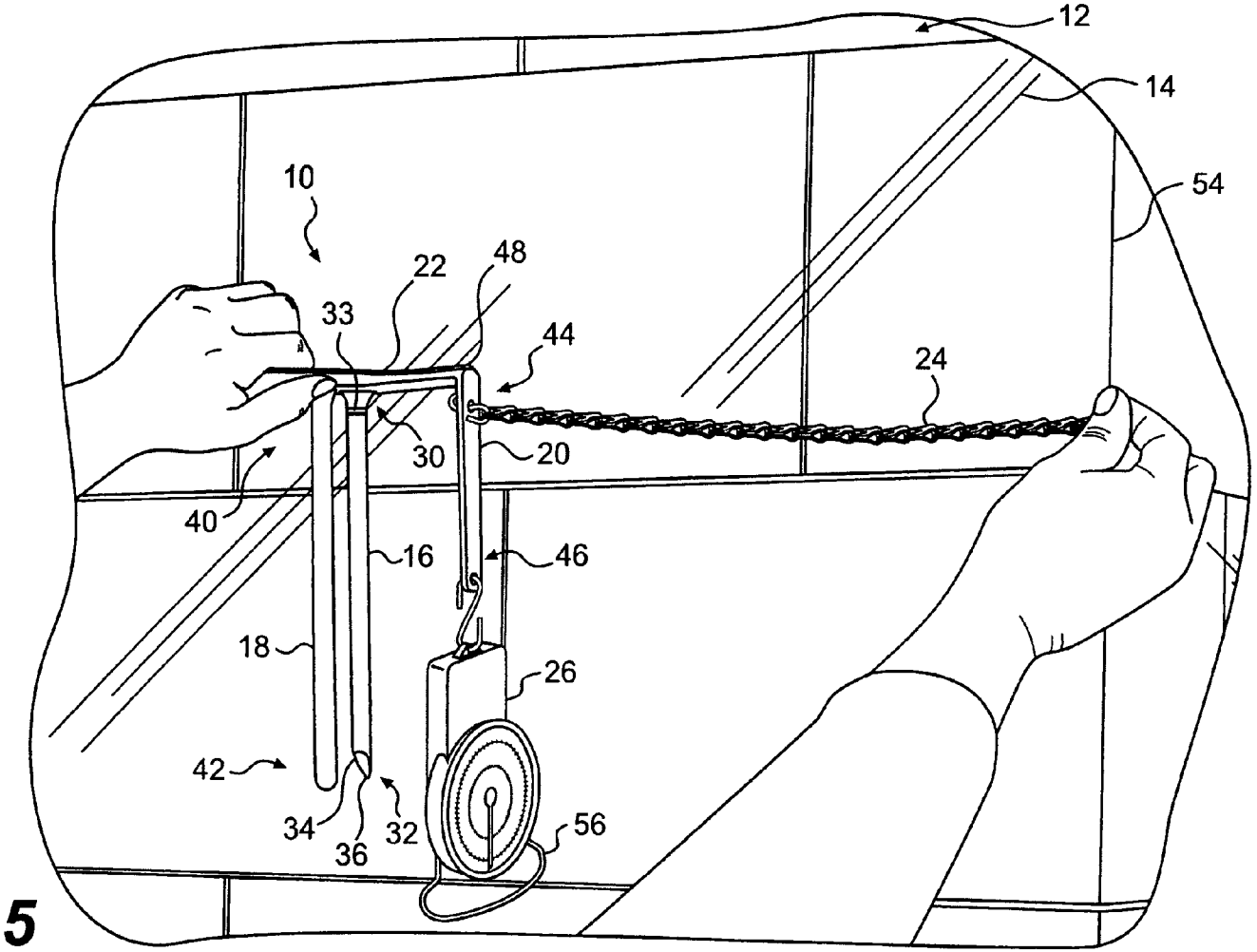
FIG. 5 is a perspective view of the apparatus of FIG. 1 in use, according to one aspect of the disclosure.

The user may hold a free end 53 of the measuring device against an edge 54 or corner of the load 12, extending the rest of apparatus 10 away from the edge 54 until the apparatus 10 comes to a point along the load surface 38, shown in FIG. 5, corresponding to where the measuring device 24 becomes taut. At this point, the user may puncture the packaging material 14 using the point 36 of sharpened edge 34 of the piercing arm 16 to position the piercing arm 16 between the packaging material 14 and the load 12. By letting the user know where to take the measurement of containment force, the measuring device 24 allows the user to use the apparatus 10 consistently between successive wrapped loads, which reduces the number of variables that may affect the measurement. Reducing the number of variables may improve accuracy and precision and reduce uncertainty. The measuring device 24 also promotes repeatable and consistent results between different users. This is important when different people working different shifts will be taking the containment force measurements that will be used to establish a protocol or standard.

Figure 8:
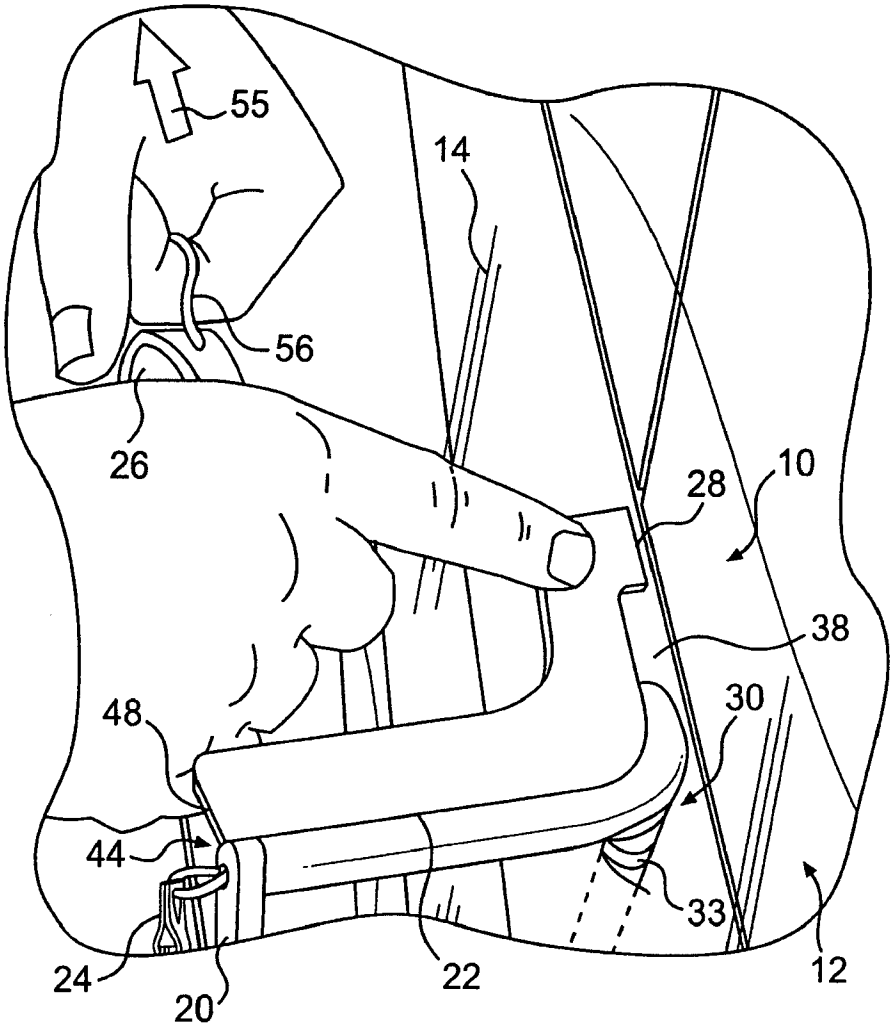
FIG. 8 is a perspective view of the apparatus of FIG. 1 in use, according to yet another aspect of the disclosure.

The free end 46 of the centering arm 20 is coupled to the gauge 26. The gauge 26 may include, for example, a spring scale hung on the free end 46 of centering arm 20. Alternatively, any measuring device, such as an electronic scale, that measures force may be used. As noted, the centering arm 20 has a length approximately half that of the piercing and rolling arms 16, 18. This places the free end 46 of the centering arm at the approximate center of the piercing and rolling arms 16, 18. The position of the free end 46 maintains vertical alignment of the piercing and rolling arms 16, 18, during measurement of the containment force. The user may exert a pulling force 55 on a grip 56 on the gauge 26, as shown in FIG. 8, in a direction perpendicular to the longitudinal axis of the centering arm 20, and substantially parallel to the load surface 38. The gauge 26 provides a reading of the magnitude of the pulling force exerted on the centering arm 20 by the user.

The pulling force tends to move the piercing arm 16, rolling arm 18, centering arm 20, transverse support 22, and indicator abutment 28 rotationally in a clockwise manner when viewed from the top of the wrapped load 12. During this movement, the piercing arm 16 exerts a force on the inner surface of the packaging material 14 in a direction substantially normal to the load surface 38, while the rolling arm 18 exerts a force against the outer surface of the packaging material 14 in an opposite direction.

The user may continue to exert the pulling force on the gauge 26 until the indicator abutment 28 of the transverse support 22 comes into contact with the outer surface of the packaging material 14 and the load 12. Once the indicator abutment 28 makes contact, the user may take a reading of the force the user is exerting on the centering arm 20 using the gauge 26, the reading being indicative of the containment force exerted on the load 12 by the packaging material 14 at the location being tested. The indicator abutment 28, by ensuring that the user pulls the centering arm 20 through the same arc each time the apparatus 10 is used, allows the user to measure the containment force consistently between successive wrapped loads. The arrangement of the piercing arm 16, rolling arm 18, centering arm 20, transverse support 22, and indicator abutment 28, may be selected so that piercing arm 16, rolling arm 18, centering arm 20, transverse support 22, and indicator abutment 28, may rotate sufficiently to allow an accurate reading to be taken using gauge 26, but not to rotate so far as to cause excessive stretching or tearing of the packaging material 14 at the aperture created by the piercing arm 16. Further, it may be preferable to space the piercing arm 16 apart from the rolling and centering arms 18 and 20 such that a user can use the piercing arm 16 without the rolling and centering arms 18 and 20 interfering by bumping or catching the packaging material 14.

Figure 14:
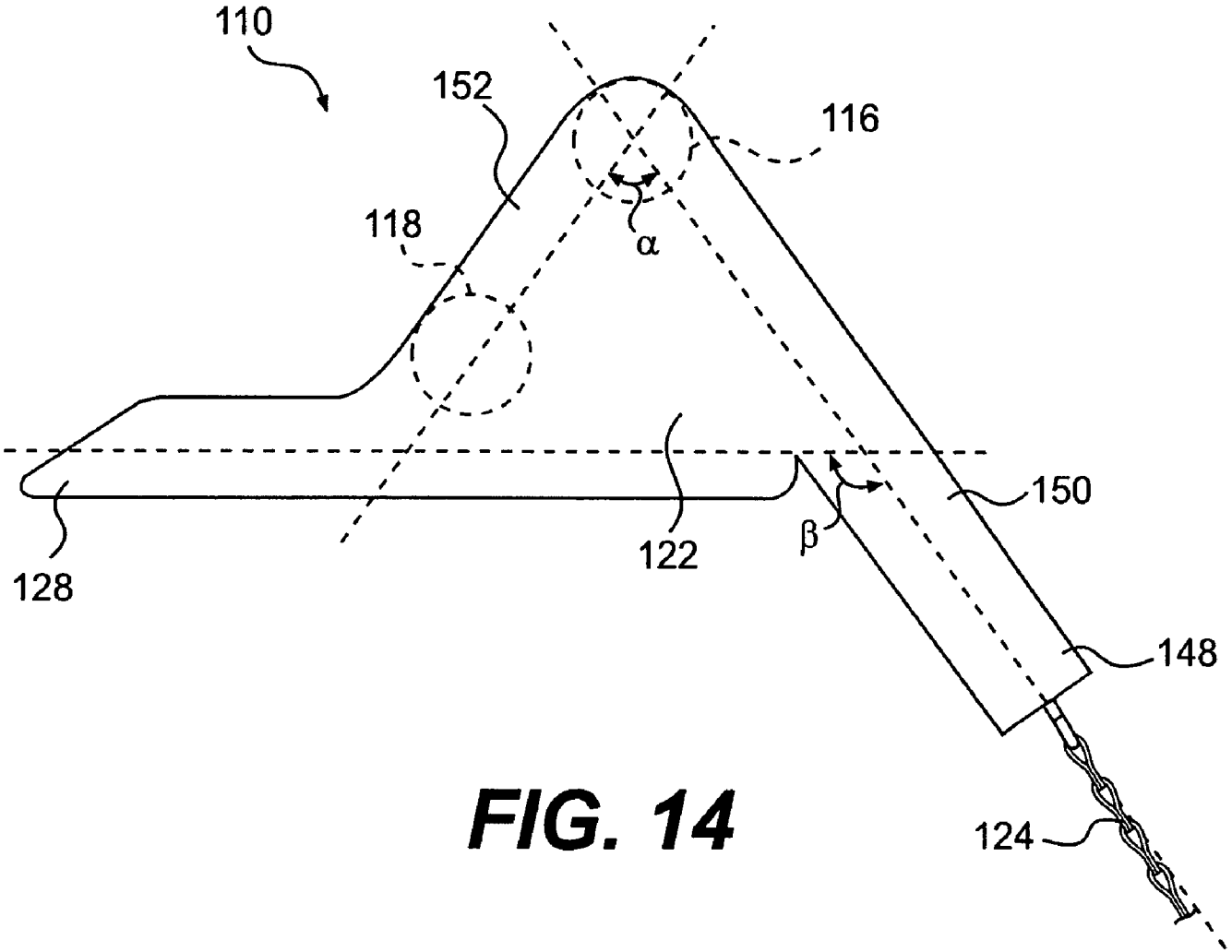
FIG. 14 is a top view of an apparatus for measuring containment force according to another aspect of the disclosure.

The transverse support may have different configurations. For example, FIG. 14 shows an alternative embodiment, apparatus 110, which may include a piercing arm 116, a rolling arm 118, a centering arm 120, a transverse support 122 having a first part 150, a measuring device 124, an indicator abutment 128. Aside from transverse support 122, the elements shown may be similar to those described with respect to apparatus 10. When viewed from the top, a line through the centers of piercing arm 116 and rolling arm 118 may form an angle $\alpha$ with the longitudinal axis of the first part 150 of the transverse support 122. The longitudinal axis of the indicator abutment 128 may form an angle $\beta$ with the longitudinal axis of the first part 150 of the transverse support 122. This arrangement may also allow for rotation of apparatus 110 to provide an accurate reading using gauge 26, while discouraging excessive stretching or tearing of packaging material. Apparatus 110 may rotate through less of an arc than apparatus 10 before indicator abutment 128 abuts the load, and thus, apparatus 110 may stretch the packaging material less than apparatus 10. This may allow apparatus 110 to be used in situations where stretching the packaging material during testing is difficult or undesirable.

According to another aspect of the disclosure, a method of using the apparatus 10 will now be described. In order to obtain an overview of the containment force on the load, the user may use the apparatus 10 to measure the containment force at the top, middle, and bottom of the load after the load is wrapped. The user may approach the wrapped load 12, and may hold the free end 53 of the measuring device 24 against a reference point on the wrapped load 12, such as, for example, the edge 54 or corner of the wrapped load 12, near a top of the load. Preferably the user will select a portion sufficiently below the very top of the load to allow a full web of film to be pierced without tearing the film at the top of the load. The user may move the apparatus 10 along the surface 38 of the wrapped load 12 until the measuring device 24 becomes substantially taut, as shown in FIG. 5. The movement along the surface 38 may follow a path running substantially perpendicular to the edge 54. Once the measuring device 24 is taut, the apparatus 10 is in position for measuring containment force. After the position is found, the user may release the measuring device 24. The position may correspond to a point lower than a rope, or gathered packaging material, that may be wrapped around the top of the wrapped load 12, so that the apparatus 10 does not take into account the containment force exerted by the rope when a measurement is taken. Additionally or alternatively, the position may correspond to a point on or above the rope, so that the containment force exerted by the rope is measured.

The user may puncture the packaging material 14 wrapped on the load using the sharp edge 34 and 36 of the piercing arm 16, and may insert the piercing arm 16 between the packaging material 14 and the load 12 in a direction generally parallel with the corner or edge 54 of the load, as shown in FIGS. 6 and 7. Grasping the grip 56 on the gauge 26, the user may exert a pulling force 55 on the centering arm 20 in a direction away from the corner or edge 54, and substantially perpendicular to the longitudinal axis of the centering arm 20, as shown in FIG. 8. As the user continues to exert the pulling force, the piercing arm 16, rolling arm 18, centering arm 20, and indicator abutment 28 may rotate in a clockwise direction when viewed from above the wrapped load 12.

The user may continue exerting the pulling force on the centering arm 20 until the indicator abutment 28 abuts the surface 38 of the wrapped load. At this point, the user may read the gauge to determine the containment force exerted by the packaging material 14 on the wrapped load 12 at the selected position.

This process may be repeated to obtain containment force readings for other areas of the load, such as the middle and base of the load, to obtain a load containment profile.

According to another aspect of the disclosure, a method of using the apparatus 10 to determine a containment force profile of a wrapped load will now be described.

Figure 9:
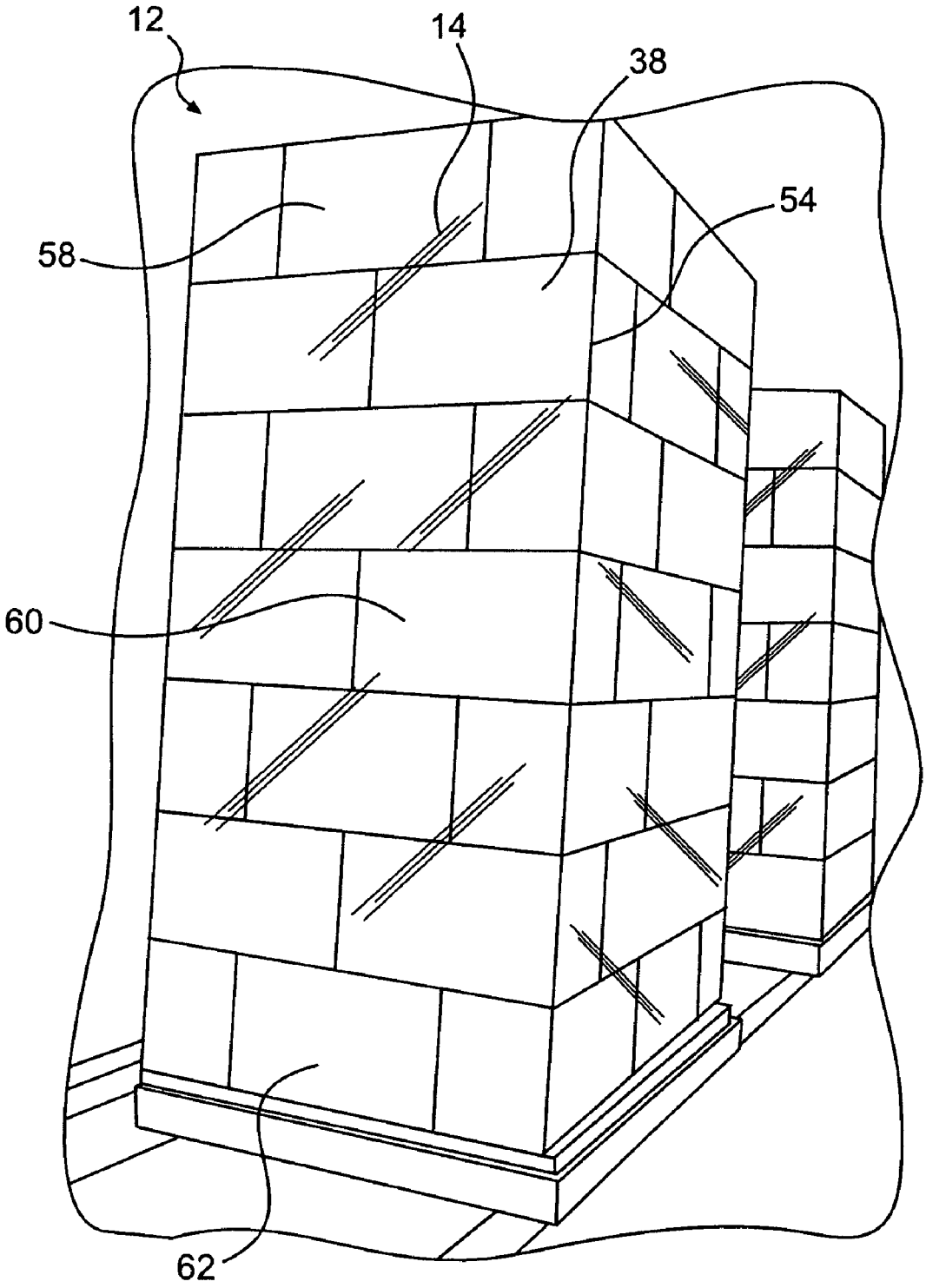
FIG. 9 is a perspective view of a wrapped load, according to one aspect of the disclosure.
Figure 10:
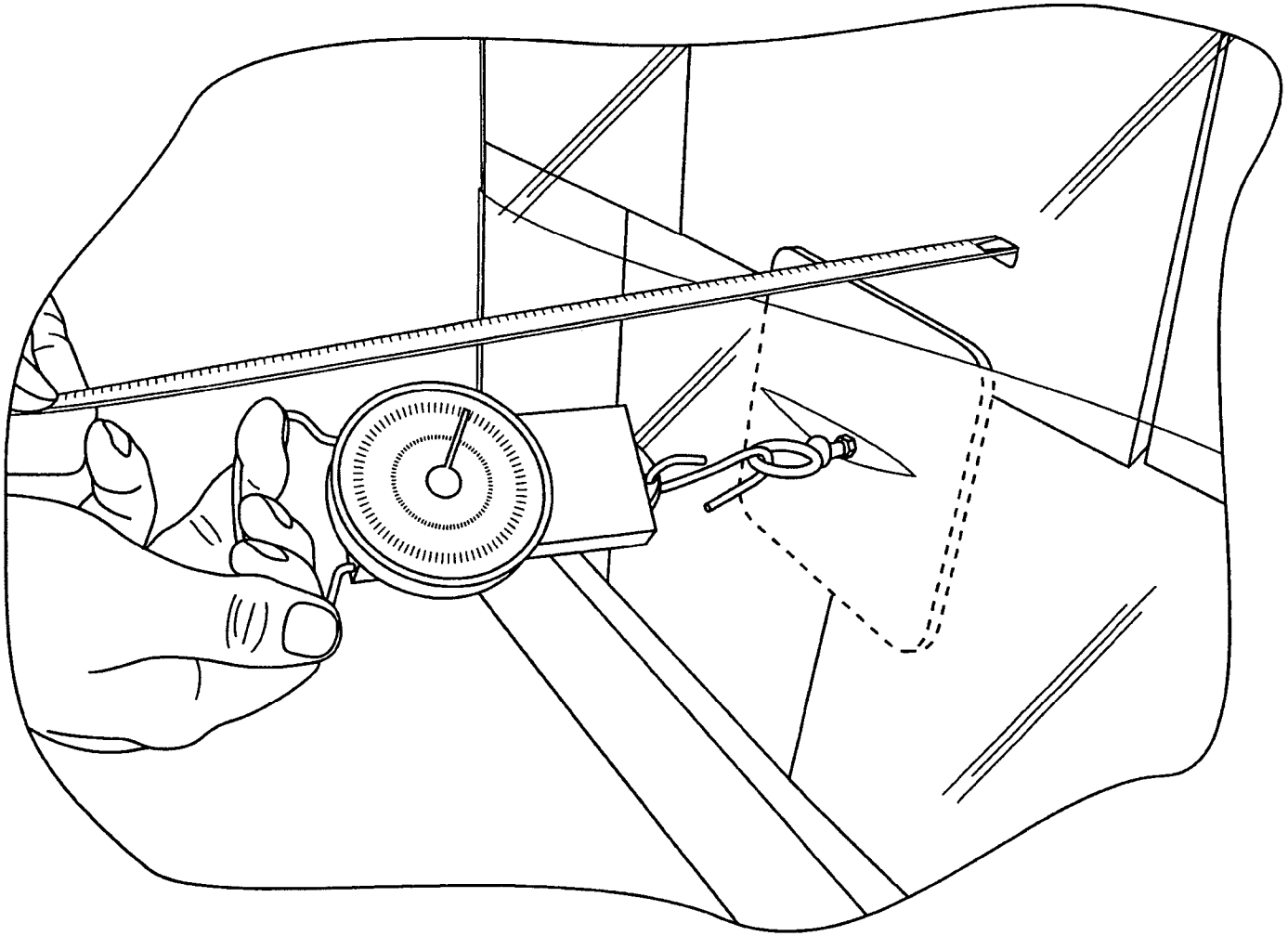
FIG. 10 is a perspective view of a measuring device in use.
Figure 11:
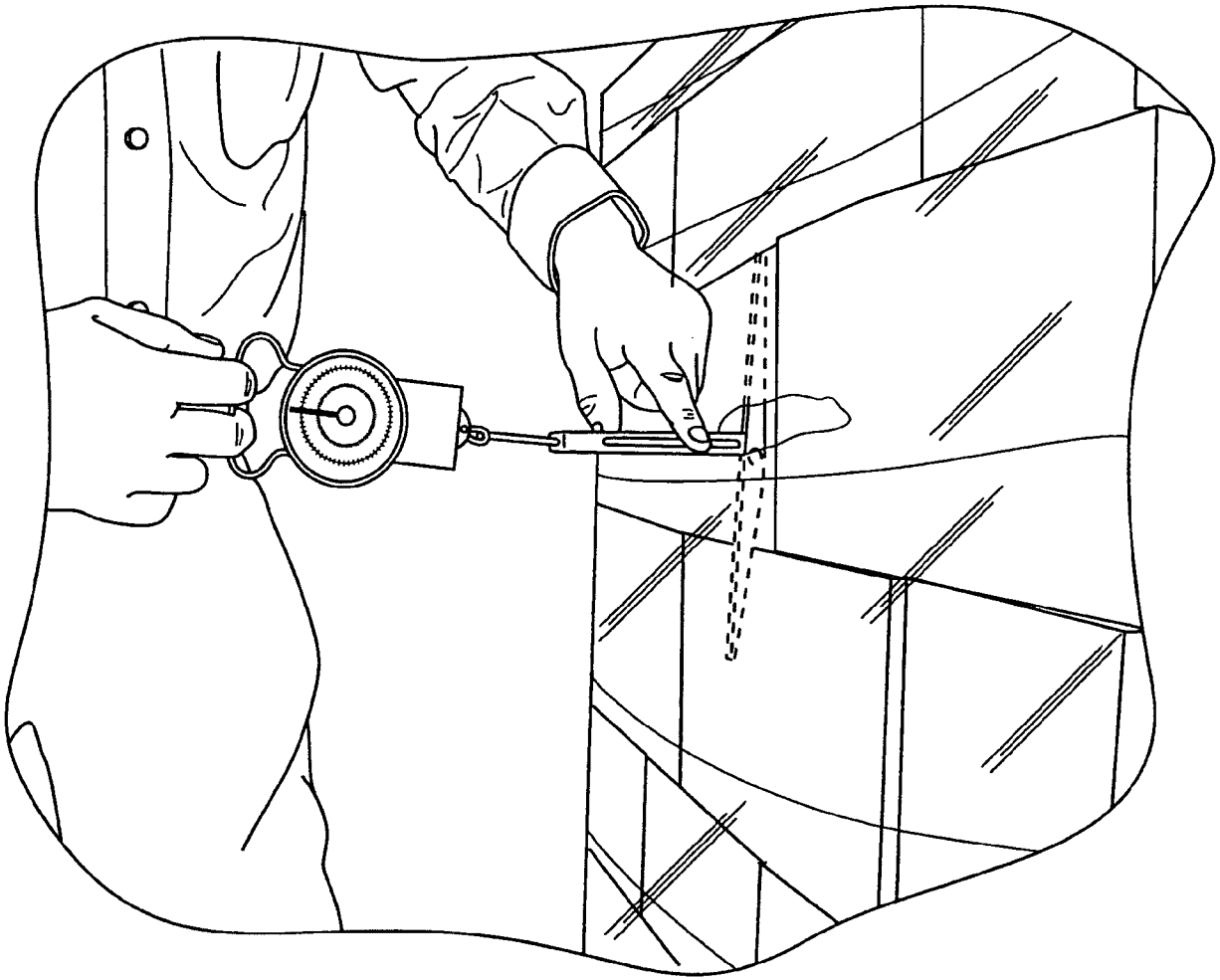
FIG. 11 is a perspective view of another measuring device in use.
Figure 12:
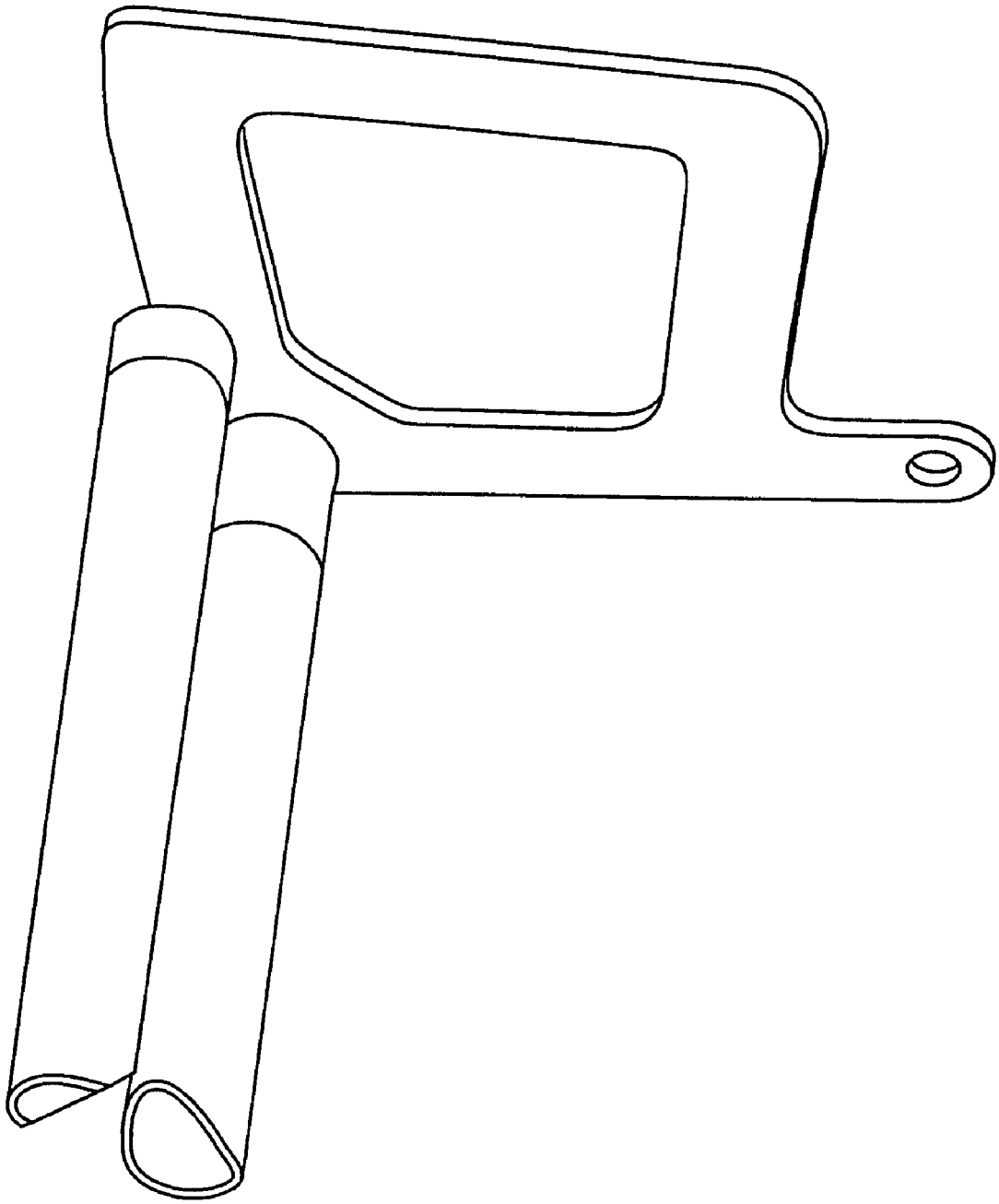
FIG. 12 is a perspective view of yet another measuring device.

After wrapping, the user may approach the wrapped load 12, and using the method previously described, the user may determine the containment force at a first position 58 at a point proximate to the top portion of the wrapped load 12. The first position 58 is shown in FIG. 9. Next, the user may remove the piercing arm 16 from between the packaging material 14 and the load 12. The user may locate another point, or second position 60, vertically below the first position 58 and proximate a midpoint of the surface 38 of the wrapped load 12. At the second position 60, the user may puncture the packaging material 14, and repeating the steps set forth above, the user may determine the containment force exerted by the packaging material 14 on the wrapped load 12 at the second position 60. The user may then locate another point, or third position 62, vertically below the first and second positions 58 and 60, and proximate a bottom portion of the wrapped load 12. At the third position 62, the user may puncture the packaging material 14, and repeating the steps set forth above, the user may determine the containment force exerted by the packaging material 14 on the wrapped load 12 at the third position 62. The containment forces at the first, second, and third positions, 58, 60, and 62, taken together, define a containment force profile for the wrapped load 12. While three positions 58, 60, and 62 have been used in the example above, it is contemplated that the user may measure the containment forces at any number of positions on the wrapped load 12 to determine the containment force profile. In selecting the position of locations 58, 60, 62, the user will select a position sufficiently far away from a top and bottom of the load to permit the piercing arm 16 of apparatus 10 to puncture the packaging material in the approximate center of the width of the web of film wrapped on the load. Similarly, for the center reading, the user will select a position that permits puncturing of the approximate center of the width of the web of film wrapped on the load. Additionally or alternatively, the user may select positions proximate the top and bottom of the load to allow the apparatus 10 to engage roped packaging material that may be used at the top and bottom ends of the load.

According to yet another aspect of the disclosure, exemplary embodiments of a wrapping process control method will now be described.

While a wrapped load is being transported to its destination, it may be subjected to forces that may test the packaging material's ability to maintain the integrity of the wrapped load, or in other words, keep the articles that make up the wrapped load in a tightly wrapped formation. These forces may cause excessive or undesirable load shifting, layer distortion, crushing, and weakening of the packaging material. Such forces may occur due to rough handling of the wrapped load, jostling during transportation on a flatbed or in a truck, or placement of the wrapped load on uneven surfaces. If, however, the wrapped load is in an acceptable condition upon its arrival at its destination, that provides a strong indication that any other wrapped loads, wrapped in the same or equivalent manner as the transported wrapped load (e.g., wrapped at the same containment force profile) will also survive being transported.

As discussed before, containment force is the primary determinant of whether the load will be maintained in the "as made" or "as wrapped" condition during and after shipment. It is desirable to determine an "optimum" containment force that is sufficiently high to permit the load to survive shipping in an acceptable condition while simultaneously identifying a containment force that also will minimize the costs associated with wrapping the load. Since the containment force on the load may not be consistent throughout the load, a containment force profile for a given wrapped load may be determined by measuring the containment force of the wrapped load at the top, middle, and bottom of the wrapped load.

Accordingly, the user may measure the containment force profile of the successfully transported wrapped load using the apparatus 10 and methodology described above, and use it as a baseline or standard containment force profile for qualifying subsequently wrapped loads prior to shipping. Wrapped loads failing to meet the baseline containment force profile may be re-wrapped. Additionally or alternatively, the wrapping process may be modified to correct the discrepancy.

Finding the baseline containment force profile may be beneficial to users in a number of other ways. For example, the optimum settings for reproducing the baseline containment force profile may be determined. The settings may include film type (e.g., film material, film gauge, and/or any other suitable characteristics), amount of film required, film pre-stretch level (if any), payout percentage, and other wrapping process variables. As used herein, payout percentage is defined as the percent of load girth dispensed for each revolution of the packaging material dispenser relative to the load. The settings may be modified, with the resulting effects on the containment forces and containment force profile being studied using the apparatus 10, thus allowing a user to experiment with the settings to find those that are most desirable in terms of cost and efficiency and are still capable of achieving the baseline containment force profile. Those settings may form the basis for a desired wrapping profile.

Figure 13:
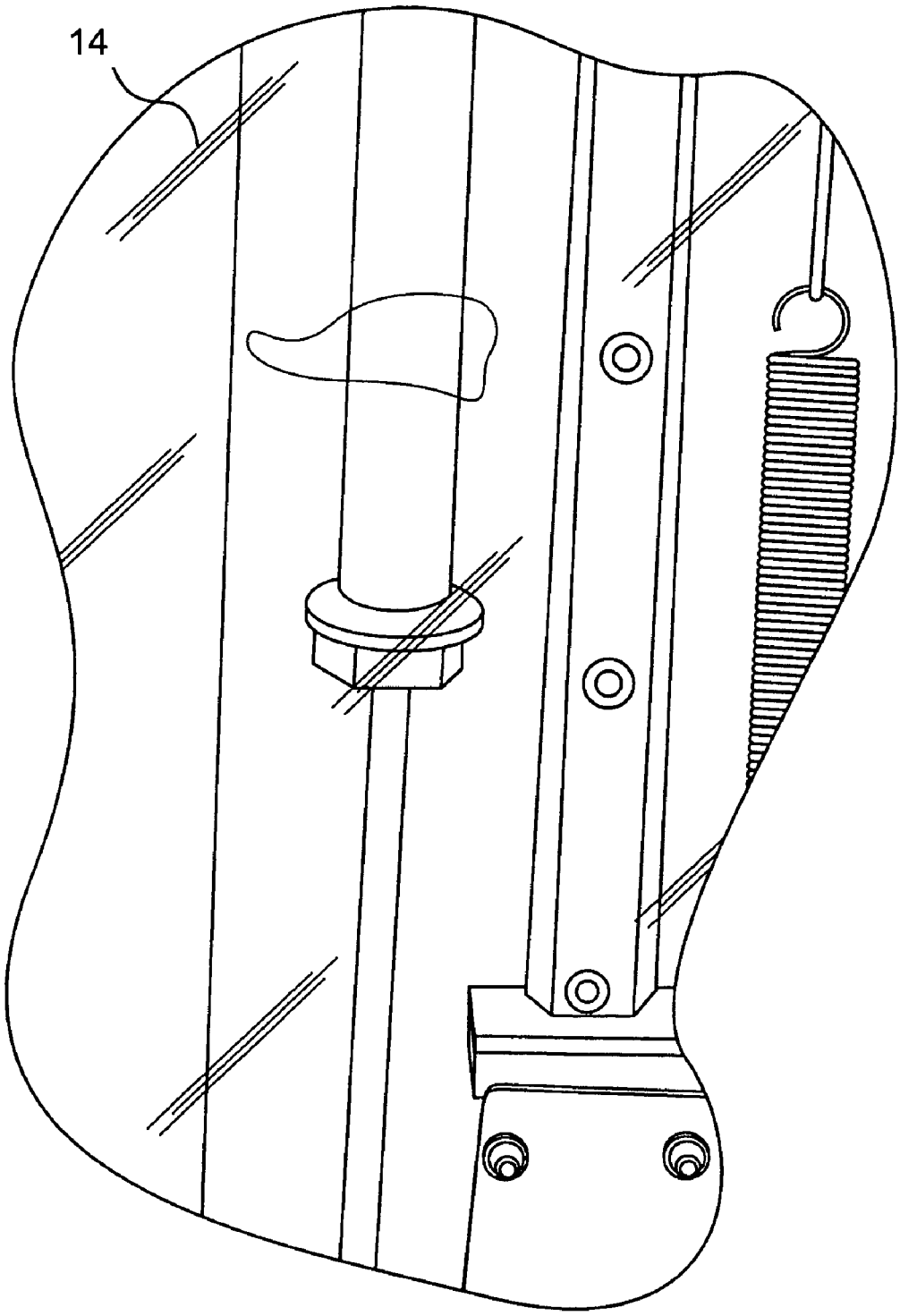
FIG. 13 is a perspective view of punctured film, according to one aspect of the disclosure.

A user may begin the process of determining the optimum settings, or desired wrapping profile, by finding the non-film break point for a chosen film type, and load profile. If stretch-wrap packaging material is used, the process may include finding the pre-stretch level. The non-film break point may be determined by puncturing the film downstream from the wrapping apparatus, but upstream from the load, to simulate a worst condition scenario (see FIG. 13). The wrapping apparatus may be started at full speed to see if a film break occurs. If so, the payout percentage is adjusted in increments until the lowest payout that will consistently start film dispensing without a film break occurring is found. That point is the non-film break point for the chosen film type and load profile. The user may wrap the load with the wrapping apparatus set to reproduce the baseline containment force profile at the settings corresponding to the non-film break point. Afterwards, the film may be unwrapped from the load and weighed to determine the amount of film required to obtain the desired containment force at those given wrapping parameters. This process may be repeated with alternative film types, pre-stretch levels, and load profiles, to find the desired wrapping profile, i.e., an optimal combination of settings for the wrapping process that is still capable of reproducing the desired containment force profile. Once an optimum set of wrapping parameters is established, it is unnecessary for workers to change the settings of the wrapping apparatuses between loads or during shift changes. The only activity required by the workers will be changing the film rolls, thus streamlining the wrapping process.

This process may be carried out on loads wrapped using other production lines, or for loads with different load profiles, to provide a better understanding of the causes of any variations and fluctuations in containment force profile measurements. This data may provide users with a better understanding of their overall operations. In order to expedite the taking of measurements, it is contemplated that for each shipment of wrapped loads, one or more of the wrapped loads may be marked to identify it as the one that should be tested using the apparatus 10.

As an added benefit, if at some point the settings unexpectedly fail to produce the desired containment force profile, this failure may alert the user to potential problems upstream in the wrapping process, allowing the user to add, remove, or otherwise modify the wrapping process to remedy the problems. Thus, measuring the containment force profile of wrapped loads after wrapping may provide users with feedback so that users may make changes upstream so that subsequently wrapped loads will meet the desired specifications. For example, upon receiving negative feedback, the user may investigate wrapping process controls, including settings used in the wrapping process, to determine if making modifications to those settings may be desirable. The user may also investigate his or her supply chain to find out whether film, machine components, and/or other materials, that received from suppliers are defective, and if so, to determine whether changing relationships with those suppliers might be beneficial. Additionally, the user may investigate whether training programs should be modified to make machine operators more adept at identifying and avoiding potential problems, and also at fixing problems that may arise during the wrapping process. Moreover, if and when changes are made to the wrapping process, their downstream effects on containment force profile may be monitored and analyzed using measurement device 24, thus providing the user with a way to gauge the effectiveness of the changes.

There are numerous advantages associated with the apparatus 10 and methods described above. For example, the apparatus 10 may be used quickly to take containment force measurements and determine containment force profiles. It is estimated that a trained user will require approximately 15 seconds to make a containment force measurement, and that a containment force profile for a wrapped load may be obtained in less than one minute using the apparatus and method of the present disclosure. This is a large time savings in comparison to other devices and methods, which may require approximately one minute for each containment force measurement.

In addition, the measurement device 24 helps to ensure that a user will position the apparatus consistently from one wrapped load to the next, thus improving consistency, accuracy, and precision and reducing uncertainty in the containment force measurements taken using the apparatus 10. Also, a user can carry the apparatus 10 to wrapped loads, and need only puncture the packaging material 14 using the sharp edge 34 and point 36 of the piercing arm 16 to position the apparatus 10 for taking a containment force measurement. The puncture created by the piercing arm 16 is relatively small, helping to minimize the damage to the packaging material 14, which helps to maintain the integrity of the wrapped load 12. Furthermore, the user need only exert 15 pounds of force, or more preferably 3-7 pounds of force, on the centering arm 20 while taking the measurement, which allows the apparatus 10 to be used without excessive physical exertion on the part of the user.

Additionally, by establishing a baseline containment force profile, wrapped loads may be qualified prior to being transported to make certain that the wrapped loads meet or exceed the baseline containment force profile. Also, optimum settings required to reproduce the baseline containment force profile may be determined. The settings may include film type, amount of film required, film pre-stretch level (if any), payout percentage, and other wrapping process variables. Knowing the optimum settings may help users to improve the efficiency of their wrapping processes. Furthermore, measuring the containment force profile of wrapped loads after wrapping may provide users with continuous feedback so that users may make changes upstream so that subsequently wrapped loads will meet the desired specifications.

Other embodiments will be apparent to those skilled in the art from consideration of the specification and practice of the embodiments disclosed herein. It is intended that the specification and examples be considered as exemplary only, with a true scope and spirit of the disclosure being indicated by the following claims.

What is claimed is:

1. An apparatus for measuring containment force on a load, the apparatus comprising:

a first longitudinally extending arm configured to engage a first side of packaging material wrapped around the load;

a second longitudinally extending arm configured to engage a second side of the packaging material, the second side being opposite the first side;

an indicator positioned substantially perpendicularly to the first and second arms;

a third longitudinally extending arm; and a force gauge configured to measure a force exerted on the third longitudinally extending arm.

2. The apparatus of claim 1, wherein a length of each of the first and second longitudinally extending arms is sufficient to engage at least half of a width of the packaging material.

3. The apparatus of claim 1, wherein the third longitudinally extending arm has a free end coupled to the force measuring device, and wherein the free end is located at an approximate center of the apparatus.

4. The apparatus of claim 1, further including a measuring device having a fixed length.

5. The apparatus of claim 4, wherein the fixed length is equal to a distance between a corner of a standard load to a point on a side surface of the standard load.

6. The apparatus of claim 4, wherein the measuring device is coupled to a fixed end of the third longitudinally extending arm.

7. The apparatus of claim 1, wherein the first, second, and third longitudinally extending arms are cantilever arms that extend from a transverse support.

8. The apparatus of claim 7, wherein the indicator is on the transverse support.

9. The apparatus of claim 7, wherein the transverse support includes a first part from which the third longitudinally extending arm extends, and a second part from which the first and second longitudinally extending arms extend.

10. The apparatus of claim 9, wherein the first part forms an angle with the second part.

11. The apparatus of claim 1, wherein the first longitudinally extending arm includes a sharp end configured to pierce the packaging material.

12. A method for determining containment force on a wrapped load, the method comprising:

positioning a portion of packaging material wrapped on the load between first and second arms of a force measuring device;

rotating the first and second arms from an initial position to an end position while the packaging material is between the first and second arms; and measuring a force required to rotate the first and second arms to the end position.

13. The method of claim 12, wherein positioning a portion of the packaging material includes inserting the first arm between the portion of the packaging material wrapped on the load and a surface of the load.

14. The method of claim 13, wherein positioning a portion of the packaging material further includes positioning the second arm on a side of the portion of the packaging material opposite the first arm.

15. The method of claim 13, wherein inserting the first arm includes puncturing the packaging material with a sharp end of the first arm.

16. The method of claim 12, wherein rotating the first and second arms presses the first arm against a first side of the packaging material, and the second arm against a second side of the packaging material, the second side being opposite the first side.

17. The method of claim 12, wherein rotating the first and second arms includes exerting a force on a third arm connected to the first and second arms.

18. The method of claim 17, wherein exerting a force on a third arm includes pulling on a gauge coupled to an end of the third arm located midway between a top and a bottom end of the force measuring device.

19. The method of claim 17, wherein exerting a force on a third arm includes exerting between about three and about fifteen pounds of force on the third arm.

20. The method of claim 12, further comprising determining a measuring position by measuring a distance from a corner of the wrapped load to a point on the side of the load at which the measurement is made.

21. The method of claim 20, wherein determining a measuring position includes positioning a first end of a positioning device having a predetermined length at the corner of the wrapped load and extending the positioning device to its full length in a direction substantially perpendicular to an edge of the load formed by the corner to indicate the measuring position on a surface of the load.

22. The method of claim 12, wherein positioning a portion of packaging material wrapped on the load between first and second arms of a force measuring device includes positioning a portion of packaging material wrapped on a top portion of the wrapped load between the first and second arms of the force measuring device.

23. The method of claim 22, further comprising positioning a portion of packaging material wrapped on a middle portion of the wrapped load between the first and second arms of the force measuring device and repeating the steps of rotating and measuring.

24. The method of claim 23, further comprising positioning a portion of packaging material wrapped on a bottom portion of the wrapped load between the first and second arms of the force measuring device and repeating the steps of rotating and measuring.

25. A device for measuring containment force on a load wrapped with stretch wrap packaging material, the device comprising:

a first arm;

a second arm substantially parallel to the first arm;

a space between the first and second arm configured to receive a portion of stretch wrap packaging material wrapped on a load;

a third arm configured to permit rotation of the first and second arms relative to the stretch wrap packaging material wrapped on the load; and a force gauge configured to measure the force required to rotate the first and second arms relative to the stretch wrap packaging material wrapped on the load.

* * * * *